US007669566B2

(12) United States Patent
Methley

(10) Patent No.: US 7,669,566 B2
(45) Date of Patent: Mar. 2, 2010

(54) HYDRAULIC CAMSHAFT PHASER WITH MECHANICAL LOCK

(75) Inventor: Ian Methley, Witney (GB)

(73) Assignee: Mechadyne PLC, Kirtlington (GB)

( * ) Notice: Subject to any disclaimer, the term of this patent is extended or adjusted under 35 U.S.C. 154(b) by 0 days.

(21) Appl. No.: 11/788,244

(22) Filed: Apr. 18, 2007

(65) Prior Publication Data

US 2007/0245994 A1 Oct. 25, 2007

(30) Foreign Application Priority Data

Apr. 19, 2006 (GB) ..... 0607642.6

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 6,439,184 B1 8/2002 Takenaka et al.
2002/0139332 A1 10/2002 Takenaka
2003/0121485 A1 7/2003 Strauss
2004/0112314 A1 6/2004 Kanada et al.
2005/0092275 A1 5/2005 Plank et al.
2005/0098133 A1 * 5/2005 Smith ..... 123/90.17
2005/0205032 A1 9/2005 Lehmann et al.

* cited by examiner

*Primary Examiner*—Zelalem Eshete
(74) *Attorney, Agent, or Firm*—Chernoff, Vilhauer, McClung & Stenzel, LLP

(57) ABSTRACT

Hydraulically operated camshaft phasers are described which comprise a drive member and a driven member having a fixed range of angular adjustment and a means for mechanically locking the position of the driven member relative to the drive member when there is insufficient hydraulic pressure to operate the phaser. In the invention, the lock operates in an intermediate position within the range of adjustment, and a hydraulic circuit is provided for biasing the phaser towards the intermediate position for the lock to engage.

9 Claims, 5 Drawing Sheets

HYDRAULIC CAMSHAFT PHASER WITH MECHANICAL LOCK

CROSS REFERENCE TO RELATED APPLICATION

This application claims priority under 35 USC 119 of United Kingdom Patent Application No. 0607642.6 filed Apr. 19, 2006.

FIELD OF THE INVENTION

The present invention relates to a hydraulically operated camshaft phaser and is particularly concerned with locking the phaser in a preset position.

BACKGROUND OF THE INVENTION

It is known for hydraulically operated camshaft phasers to be fitted with a locking system to control the position of the phaser when there is insufficient oil supply pressure to do so. An example of such a system is disclosed in GB 0428063.2. Conventionally, the locking system holds the phaser at one extreme of its operating range such that it will be returned to the locking position either by the camshaft drive torque, or by a simple return spring arrangement.

It has also been proposed in the prior art (see for example GB 2372797) to lock the phaser in an intermediate position, as this allows better optimisation of the engine start-up position for the phaser. However, the prior art only discloses the use of a spring to bias the phaser towards the intermediate position in which it can be locked by the locking system.

SUMMARY OF THE INVENTION

According to the present invention, there is provided a camshaft phaser comprising a drive member and a driven member having a fixed range of angular adjustment, a means for locking the position of the driven member relative to the drive member at an intermediate position within the range of adjustment, and a means for biasing the phaser towards the intermediate position where the locking means will engage, wherein the means for biasing the phaser comprises a hydraulic system allowing unidirectional oil flow within the phaser such that the phaser moves to the lock position under the action of camshaft torque reversals.

BRIEF DESCRIPTION OF THE DRAWINGS

The invention will now be described further, by way of example, with reference to the accompanying drawings, in which:

FIG. 3 being a plan view from above; FIG. 4 a section along the line IV-IV in FIG. 3; FIG. 5 a section along the line V-V in FIG. 3; FIG. 6 a section along the line VI-VI in FIG. 4; and FIG. 7 a section along the line VII-VII in FIG. 4;

FIG. 13 being a plan view from above showing the phaser mounted on a camshaft; FIGS. 14 to 16 sections along the lines XIV-XIV, XV-XV and XVI-XVI in FIG. 13, respectively; FIG. 17 an axial section; and FIG. 18 a partially exploded view.

DETAILED DESCRIPTION OF THE PREFERRED EMBODIMENTS

Figure 1:
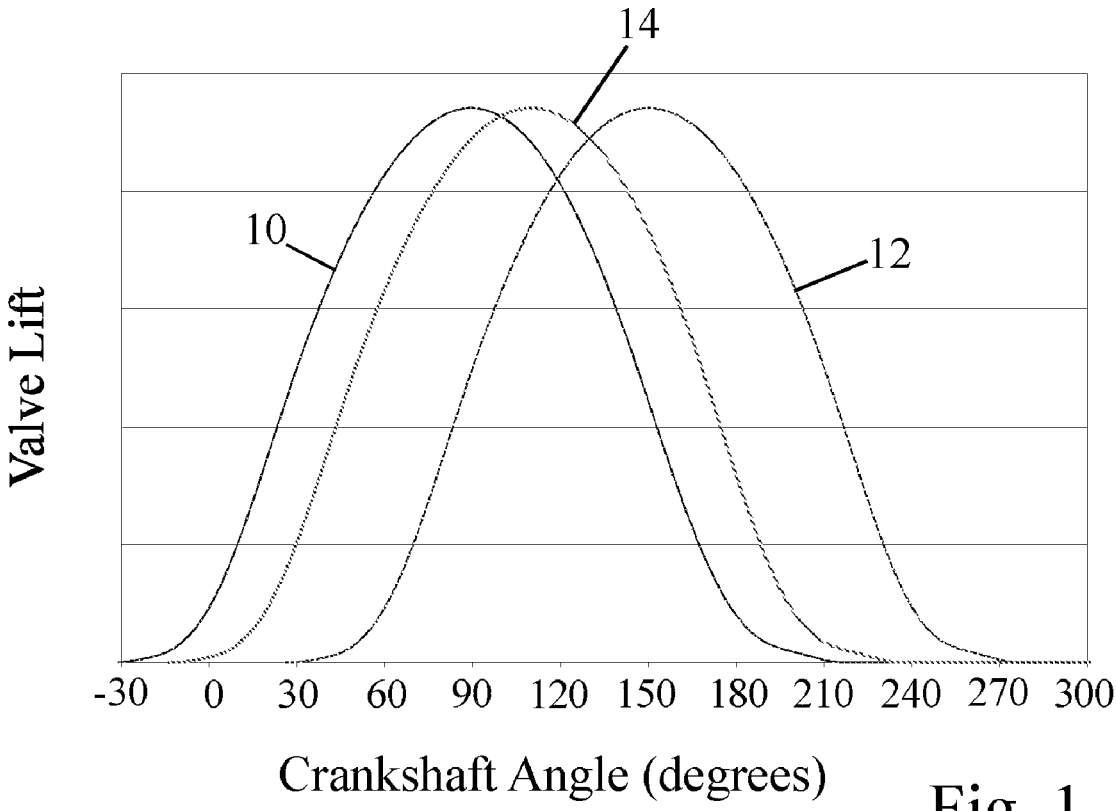
FIGS. 1 and 2 are graphs showing the range of adjustment of different camshaft phasers.

The invention may be used in a phaser for controlling the timing of intake/exhaust valve opening relative to the crankshaft, as shown in FIG. 1. The graph 10 shows a valve event when the phaser is at one end of its range and graph 12 the event of the same valve when the phaser is at the opposite end of its range. Normally, the locked position when the oil pressure is too low to operate the phaser is selected to be one or other of these two end positions but in the present invention, the phaser is designed to lock in a central position, such as the position represented by the graph 14.

Figure 2:
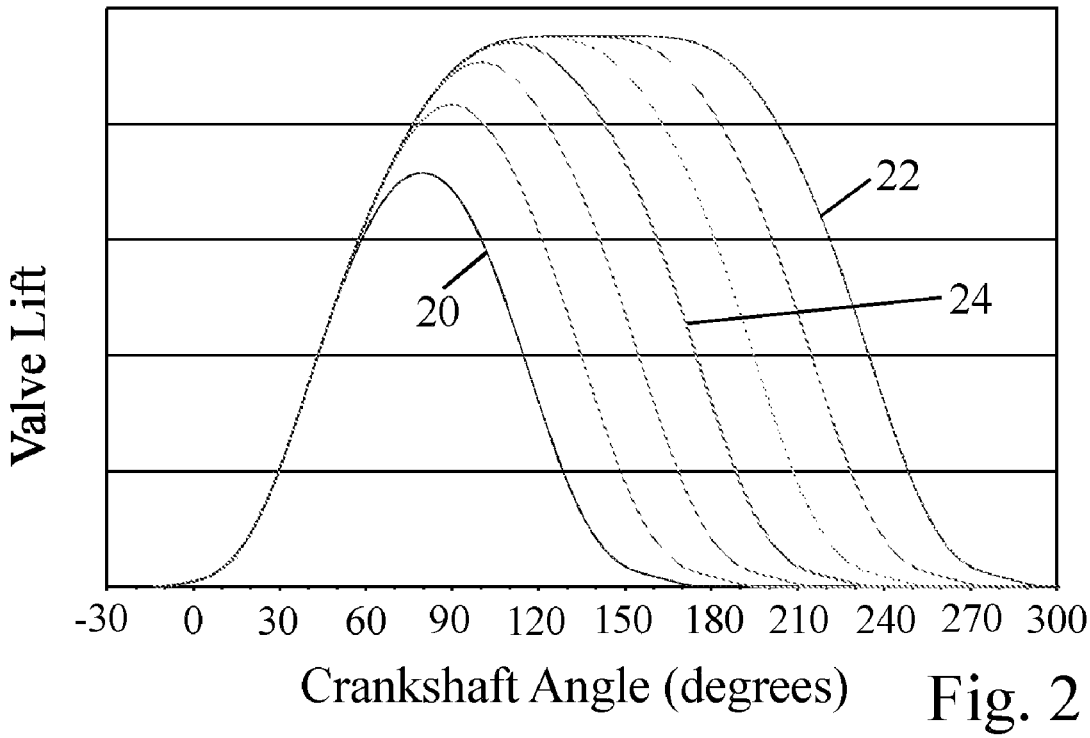
Figure 3:
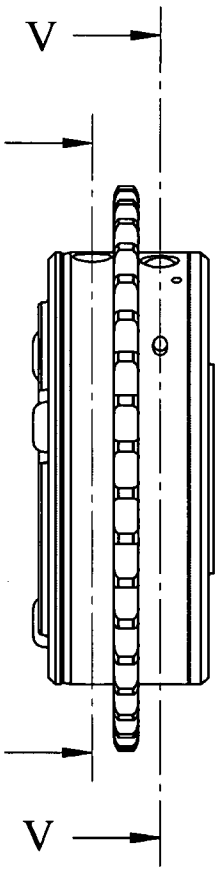
FIGS. 3 to 7 show an embodiment of the invention in a locked position.
Figure 7:
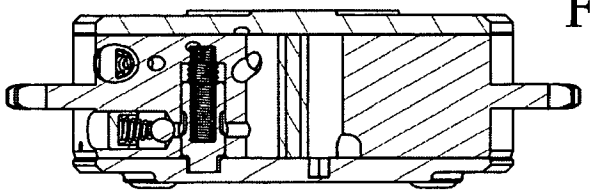

The invention can also be used in a phaser which controls the valve lift using a cam-summation system as shown in FIG. 2. The valve events in the end positions of the phaser are represented in FIG. 2 by the graphs 20 and 22 and the valve event in the locked position by an intermediate graph 24.

In the illustrated embodiments of the invention, the phaser is a vane-type phaser which is well known in the art. A full description of a similar phaser and locking pin are to be found in GB 2413168 and need not be repeated in the present context. Essentially, the phaser comprises a drive member or stator which is connected for rotation with the engine crankshaft and a driven member or rotor which comprises two end plates connected to vanes which move in and, are sealed relative to, arcuate recesses in the stator, each vane dividing its recess into two opposed working chambers. As oil is pumped into one working chamber and allowed to escape from the other, the rotor is rotated relative to the stator to vary the phase of the camshaft relative to the crankshaft. A locking pin, which is mounted in a bore in the stator, is hydraulically retracted when there is sufficient oil pressure to rotate the rotor relative to the stator. In the absence of sufficient oil pressure, an internal spring expands the locking pin and its end engages in the hole in the end plate to lock the rotor and stator relative to one another.

The embodiments of the invention rely on the torque reaction of the valve train rather than a spring to return the phaser to a central position.

As a cam of the camshaft attempts to open a valve, the camshaft drive train encounters a retarding torque but when a valve attempts to close and its movement is resisted by a cam, the camshaft encounters an accelerating torque. Consequently the torque reaction of the valve train undergoes periodic reversals. The embodiments of FIGS. 3 to 18 use one-way valves to allow oil to escape from the double acting arcuate working chambers in response to reaction torques acting in one direction but not the other.

In the embodiment shown in a locked position in FIGS. 3 to 7 and in an unlocked position in FIGS. 8 to 12, the construction of the phaser is the same as that described above in terms of the design of the rotor, the stator, the vanes and the end plates. However, instead of a single pin engaging in a hole in one of the end plates, the locking mechanism comprises two separate locking pins 200, 202 that each engage in respective slots 204, 206 in the opposite end plates 208, 210 of the phaser.

Figure 5:
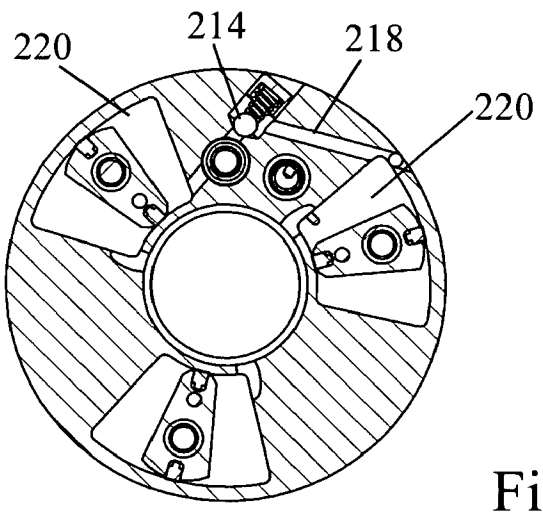
Figure 6:
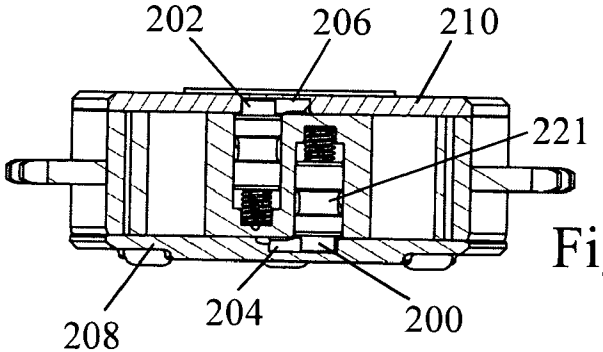
Figure 4:
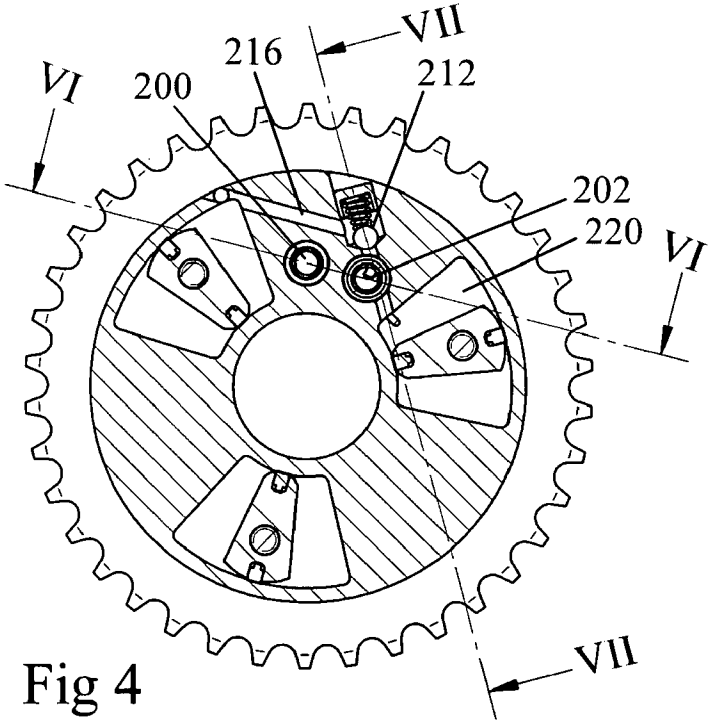
Figure 8:
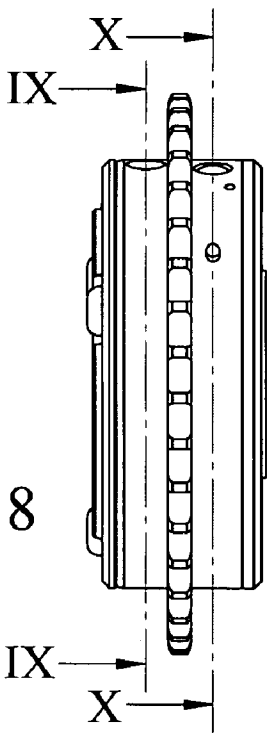
FIGS. 8 to 12 are views corresponding to FIGS. 3 to 7 of the first embodiment of the invention, showing the phaser in an unlocked position.
Figure 12:
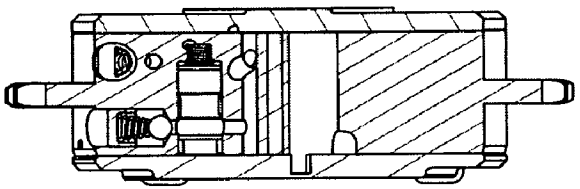
Figure 10:
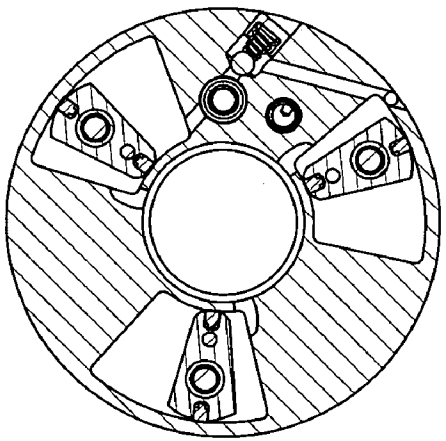
Figure 11:
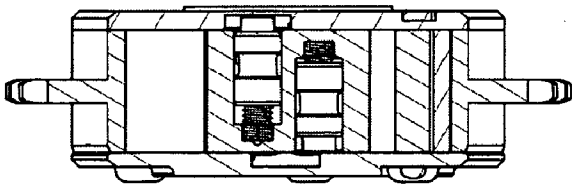
Figure 9:
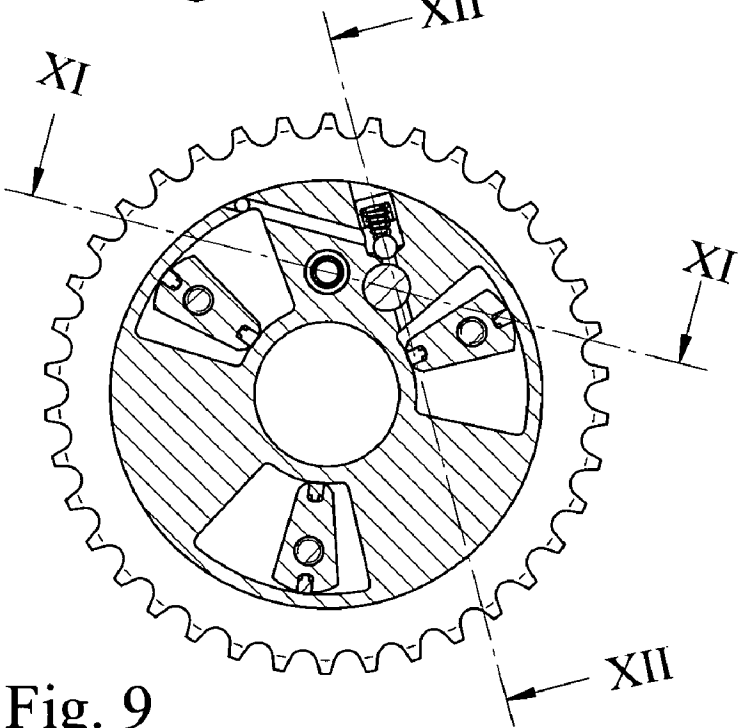

When the phaser is not in its locked position and the oil pressure in the supply to the phaser drops, only one locking pin 200, 202 can engage in its slot whilst the other will run against the inner surface of the end plate 208, 210. As shown in FIGS. 4 and 5, the bore of each locking pin 200, 202 is connected to a one-way valve 212, 214 by an oil drilling 216, 218 that also enters the adjacent vane cavity 220. When a locking pin 200, 202 is engaged in its slot 204, 206, oil is able to flow through the drilling 216, 218 by passing through a groove 221 in the outer surface of the locking pin. On the other hand, when the locking pin 200, 202 is unable to enter its slot, this oil drilling is obscured by the diameter of the pin, preventing any oil flow through the associated one-way valve 212, 214. Therefore, in the situation where the phaser is unlocked, oil may only flow through one of the one-way valves 212, 214 and the direction of oil exchange between the working chambers of the adjacent cavities acts to move the phaser to the position where the second locking pin will engage in its slot.

The one-way valves thus allow oil to pass from one vane cavity to another under the action of camshaft torque reversals. Disabling one of the valves will therefore allow the phaser to move only in one direction when it is subjected to torque reversals, the hydraulic circuit being arranged to allow the phaser to move only in the direction of the locking position.

An embodiment of the invention having a hydraulic circuit with a single locking pin 300 is shown in FIGS. 13 to 18. In this case, the locking pin 300 moves radially.

Figures 13, 14, 15:
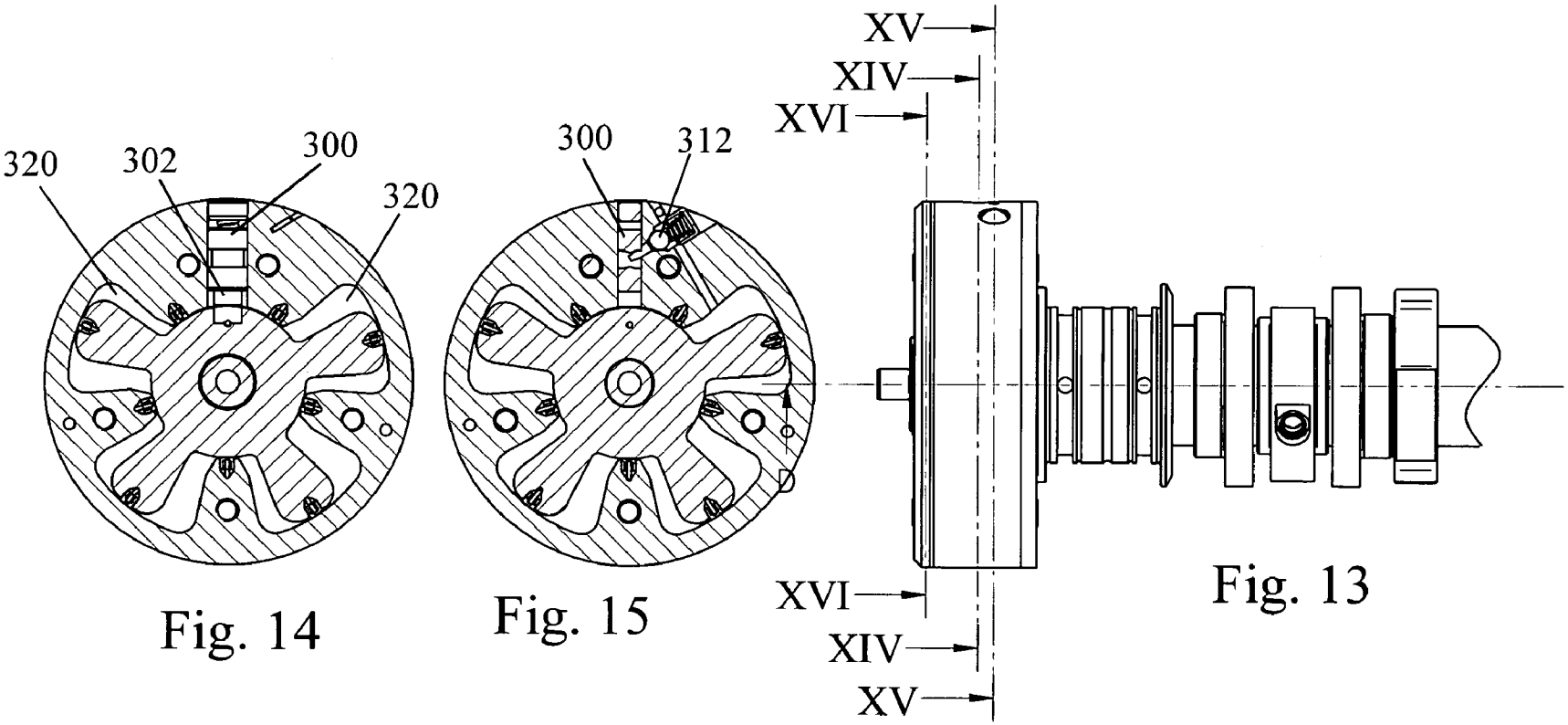
FIG. 13 to 18 show a second embodiment of the invention.

As with the previous hydraulic circuit, there are two opposing one-way valves, one of the valves 312 being shown in the section of FIG. 15. Both of these circuits are connected to one of the vane cavities 320 such that oil may only flow into the cavity, whilst the other side of the one-way valve is connected to the bore of the locking pin 300. When the locking pin is engaged, it obscures the oil feeds to both one-way valves, but when it is disengaged, as shown in FIG. 28 the oil feeds are connected by the reduced diameter portion of the locking pin 302.

Figure 16:
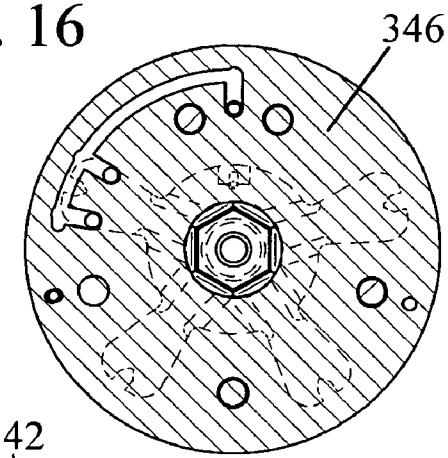
Figure 17:
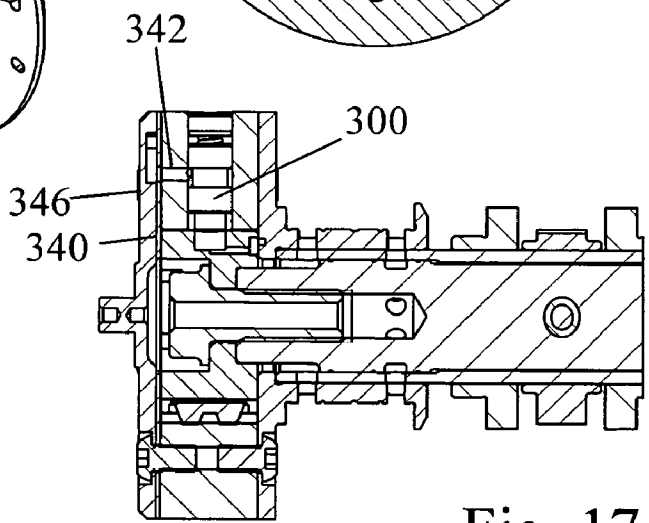
Figure 18:
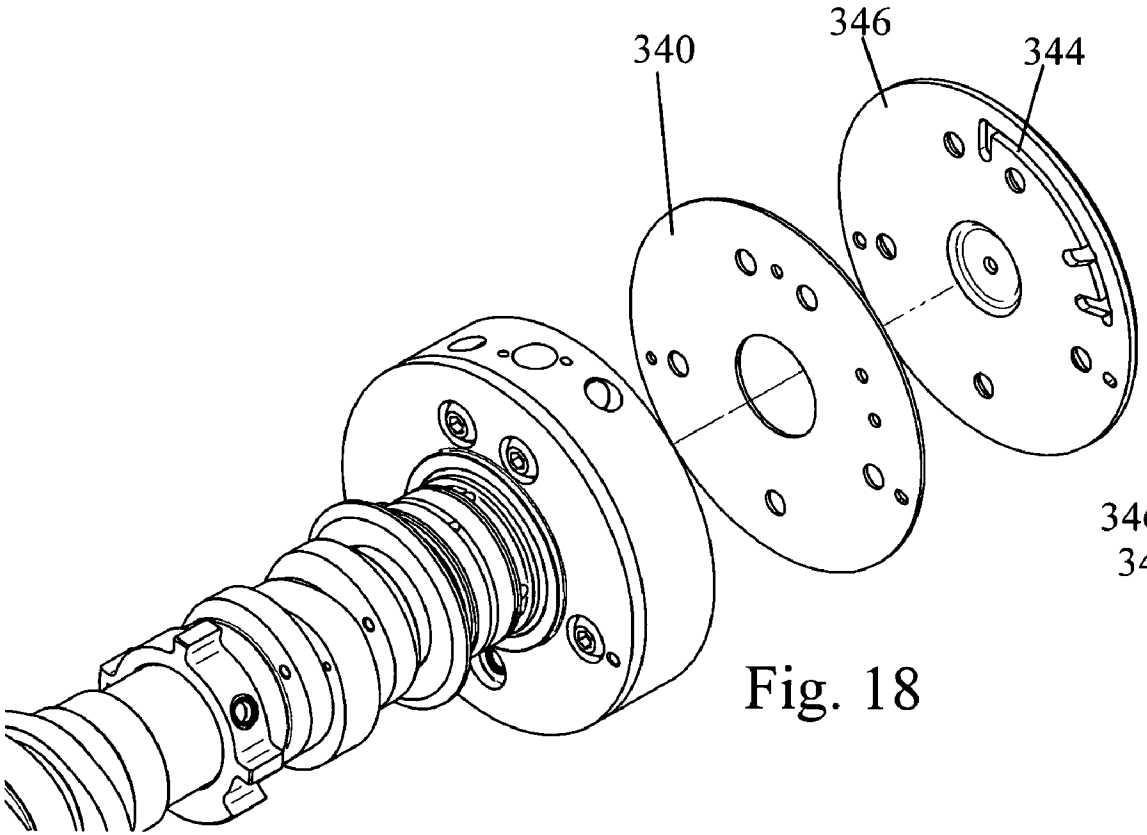

FIGS. 16 to 18 illustrate how the oil flow through the one-way valves may be controlled to ensure that the phaser will always return to its locked position. A third drilling 342 also leads into the locking pin bore as shown most clearly in FIG. 17, and this hole leads through a thin manifold plate 340 (the centre component of the exploded view in FIG. 18) into a slot 344 in the front plate 346 of the phaser. The slot 344 acts to connect the first hole to two other holes in the manifold plate that are selectively covered and uncovered by one of the phaser vanes, as shown in dotted lines in FIG. 16.

In the locked position, the vane predominantly obscures both holes—as shown in FIG. 16, but any movement of the phaser away from the locked position will uncover one of the holes, allowing oil to flow out of the associated cavity under the action of the camshaft torque reversals, and into the opposing set of cavities via the one-way valve 312. Thus the phaser will always try to return to the position where both of the holes are obscured under the action of the camshaft torque reversals, allowing the locking pin to engage.

In this embodiment, the locking pin 300 is disengaged by a separate oil pressure signal from the front bearing of the camshaft, rather than one of the control oil feeds to the phaser.

FIG. 13 also shows how the phaser may be mounted to a single cam phaser camshaft, and SCP camshaft being one in which cams mounted for rotation about the same axis can be phase shifted relative to one another. The camshaft in FIG. 13 comprises a tubular first shaft which concentrically surrounds and is rotatable relative to a second shaft, relative rotation of the two shafts causing selected cams of the camshaft to rotate relative to other cams of the camshaft. Each of the shafts of the camshaft assembly is connected for a rotation with a different respective one of the two driven of the phaser and the connections between the shafts of the camshaft assembly and the driven members of the phaser are interchangeable.

It will of course be clear that the same principle can be applied to phase a solid camshaft relative to the crankshaft.

The invention claimed is:

1. A camshaft phaser comprising a drive member and a driven member having a fixed range of angular adjustment, a means for locking the position of the driven member relative to the drive member at an intermediate locking position within the range of adjustment, and a means for biasing the phaser towards the locking position where the lock will engage, wherein the means for biasing the phaser comprises a hydraulic system contained within the phaser, the hydraulic system having at least one oil drilling and a one-way valve to control the direction of oil flow through the oil drilling, the direction of phaser rotation induced by the oil flow being determined in dependence upon the position of the drive member relative to the driven member such that the phaser always moves to the locking position under the action of camshaft torque reversals.

2. A phaser as claimed in claim 1, wherein one or more locking pins are used to selectively open an oil flow path for biasing the phaser towards its locked position depending upon whether they are engaged.

3. A phaser as claimed in claim 1, wherein the phaser is a vane-type phaser and at least one oil flow path for biasing the phaser towards its locked position is controlled in dependence upon the position of a vane of the phaser.

4. A phaser as claimed in claim 1, wherein the locking means comprises a pin that engages in a hole.

5. A phaser as claimed in claim 1, wherein the locking means comprises two pins that each engage in a corresponding slot.

6. A camshaft comprising a drive member and a driven member having a fixed range of angular adjustment, a means for locking the position of the driven member relative to the drive member at an intermediate position within the range of adjustment, and a means for biasing the phaser towards the intermediate position where the lock will engage, wherein the means for biasing the phaser comprises a hydraulic system contained within the phaser having one or more oil drillings that allow oil flow in only one direction such that the phaser moves to the locking position under the action of camshaft torque reversals, in combination with a camshaft assembly comprising a tubular first shaft which concentrically surrounds and is rotatable relative to a second shaft, wherein relative rotation of the two shafts causes selected cams of the camshaft to rotate relative to other cams of the camshaft, and wherein each of the shafts of the camshaft assembly is connected for a rotation with a different respective one of the two members of the phaser.

7. A combination as claimed in claim 6, wherein the hollow second shaft of the camshaft is coupled for rotation with the first member of the phaser and the first shaft is coupled for rotation with the second member.

8. A combination as claimed in claim 6, wherein the hollow second shaft of the camshaft is coupled for rotation with the second member of the phaser and the first shaft is coupled for rotation with the first member.

9. A camshaft phaser comprising a drive member and a driven member having a fixed range of angular adjustment, at least one hydraulic cavity formed in one of the two members and divided by a vane movable with the other of the two members to form two opposed working chambers which act respectively to advance and retard the two members of the phaser relative to one another, a locking means for locking the two members relative to one another in an intermediate locking position within the range of adjustment, and a biasing means for biasing the two members towards the intermediate locking position, the biasing means comprising at least one drilling interconnecting the two working chambers and a one-way valve allowing oil flow through the drilling in only one direction, the direction of phaser rotation induced by the oil flow being determined in dependence upon the position of the drive member relative to the driven member so as to permit the members to be driven only towards the intermediate locking position by the action of camshaft torque reversals while preventing relative motion of the two members away from the intermediate locking position.

* * * * *